US005568220A

United States Patent [19]

Joos et al.

[11] Patent Number: 5,568,220

[45] Date of Patent: Oct. 22, 1996

[54] PHOTOGRAPHIC PROCESSING APPARATUS WITH QUICK-COUPLING PROCESSING LIQUID STORAGE CONTAINER

[75] Inventors: Françcois Joos, Puurs; Patrick Van den Bergen, Berchem, both of Belgium

[73] Assignee: AGFA-Gevaert N. V., Mortsel, Belgium

[21] Appl. No.: 325,953

[22] Filed: Oct. 17, 1994

[30] Foreign Application Priority Data

Nov. 15, 1993 [EP] European Pat. Off. ..... 93203182

[51] Int. Cl.[6] ..... G03D 3/02

[52] U.S. Cl. ..... 396/626

[58] Field of Search ..... 220/235; 215/358; 354/322, 323, 324

[56] References Cited

U.S. PATENT DOCUMENTS

| | | | |
|---|---|---|---|
| 2,079,049 | 5/1937 | St. Clair | 215/358 |
| 4,533,225 | 8/1985 | Shiga | 354/322 |
| 4,759,462 | 7/1988 | Neglio | 220/235 |

FOREIGN PATENT DOCUMENTS

| | | | |
|---|---|---|---|
| 62-299851 | 12/1987 | Japan | 354/323 |

*Primary Examiner*—D. Rutledge

*Attorney, Agent, or Firm*—William J. Daniel

[57] ABSTRACT

Processing liquid supply system for the processing vessel of photographic processing apparatus wherein fresh processing liquid is delivered from and used liquid returned to a liquid storage container via corresponding conduits which may each include a liquid flow pump. The container is equipped with a push-in/pull-out cap penetrated by passageways communicating with the conduits. The cap is insertable into the container mouth and has an expandable resilient seal around its periphery for sealing engagement when expanded with the internal surface of the container mouth. A handle is pivoted on the cap for movement between cap-sealed and cap-unsealed positions. The cap has an internal piston which is linked to the handle and is displaced axially when the handle is pivoted between its positions to thereby alternatively compress the seal to expand the same and seal the container mouth and relax the seal for removal of the cap from the container. The cap can be supported on a support plate pivoted for up and down movement on the apparatus frame to thereby insert and remove the cap into and from the mouth of a container arranged beneath the plate. A liquid-filled container can be conveniently wheeled into and out of the apparatus by means of a trolley. The cap handle can have an extension adapted when the handle is pivoted to its cap sealed position to activate an electrical switch and energize a signal to indicate the position of the handle.

7 Claims, 5 Drawing Sheets

PHOTOGRAPHIC PROCESSING APPARATUS WITH QUICK-COUPLING PROCESSING LIQUID STORAGE CONTAINER

FIELD OF THE INVENTION

This invention relates to apparatus for processing photographic material, comprising a process bath connected to a storage container for process liquid.

The application is particularly relevant to storage containers for photo-chemical products for use with apparatus for processing photographic materials.

BACKGROUND OF INVENTION

Photographic processing apparatus will typically comprise a developing section, a fixing section, a washing section and a drying section.

The process liquids for the developing section and the fixing section are typically provided in containers having an opening closed by a screw threaded cap. Such containers can be in the form of rigid moulded polyethylene containers, or collapsible containers consisting of a collapsible plastic cube insert within a corrugated board outer support.

The apparatus supply conduit from the container to each of the respective section of the apparatus is normally coupled to the container by means of a screw threaded coupling to which a supply conduit is attached. This makes coupling and uncoupling the container to the apparatus cumbersome since in order to unthread the coupling either the supply conduits must be twisted, or the container has to be rotated during coupling. Furthermore such a cumbersome coupling system may lead to messy spills and wastage.

OBJECT OF INVENTION

It is object of the invention to provide an improved processing apparatus incorporating a simple push-in cap construction which permits quick coupling and uncoupling of containers without spillage.

STATEMENTS OF INVENTION

According to one aspect of the invention there is provided an apparatus for processing photographic material and which comprises at least one process bath, each such bath being filled with a liquid delivered to the bath from a storage container, the storage container being connected to the bath by a push-in/pull-out cap having a radially expandable and contractible resilient seal engagable with the mouth of said container and having a passageway connected by a conduit to the respective process baths, said cap and each conduit connected thereto being mounted on a support plate pivoted to a frame of the apparatus so that by pivoting the frame the cap can be raised and lowered into and out of the mouth of the container.

Connection caps having a radially expandable and contractible resilient seal engagable with the mouth of a holder are known, e.g. from U.S. Pat. No. 4,759,462, WO-A 91 02684 and U.S. Pat. No. 2 079 049. These caps do not constitute a handy system for connecting a container with fresh processing liquid, e.g. a jerrycan or a cubitainer with a contents of 20 l, to the supply conduit of a photographic processor, bearing in mind that suchlike container is usually at floor level and must be inserted completely into a corresponding opening of the apparatus which does not always provide sufficient finger space for mounting and removing the cap.

Preferably the resilient seal is expanded to engage inner surfaces within the mouth of the container by axial compression of the seal. The seal may be expanded and contracted through operation of a handle mounted on the cap body and having a cam surface thereon.

Suitably, the apparatus according to the invention comprises on the support plate an electrical switch which is operated by a portion of said handle when the handle is in the 'cap sealed' position. The cap can have two fluid passageways therein, one communicating with a delivery conduit leading to a bath and the other with a return conduit from the bath, respectively.

According to a further suitable embodiment of the invention, a delivery pump for delivery of liquid from the container to the bath, and a return pump for discarging liquid from the bath to the container are mounted on said support plate and connected into said delivery and return conduit.

Still further, the apparatus can comprise a trolley onto which a new full container can be loaded, the arrangement of the trolley being such that the cap fits into the mouth of said loaded container as the trolley has been inserted in the apparatus and the support plate bearing said cap is pivoted downwardly.

The apparatus according to the invention is preferably for use with collapsible storage containers especially for photographic processing liquids.

DESCRIPTION OF DRAWINGS

The invention will be described by way of example and with reference to the accompanying drawings in which.

Detailed Description

Figure 1:
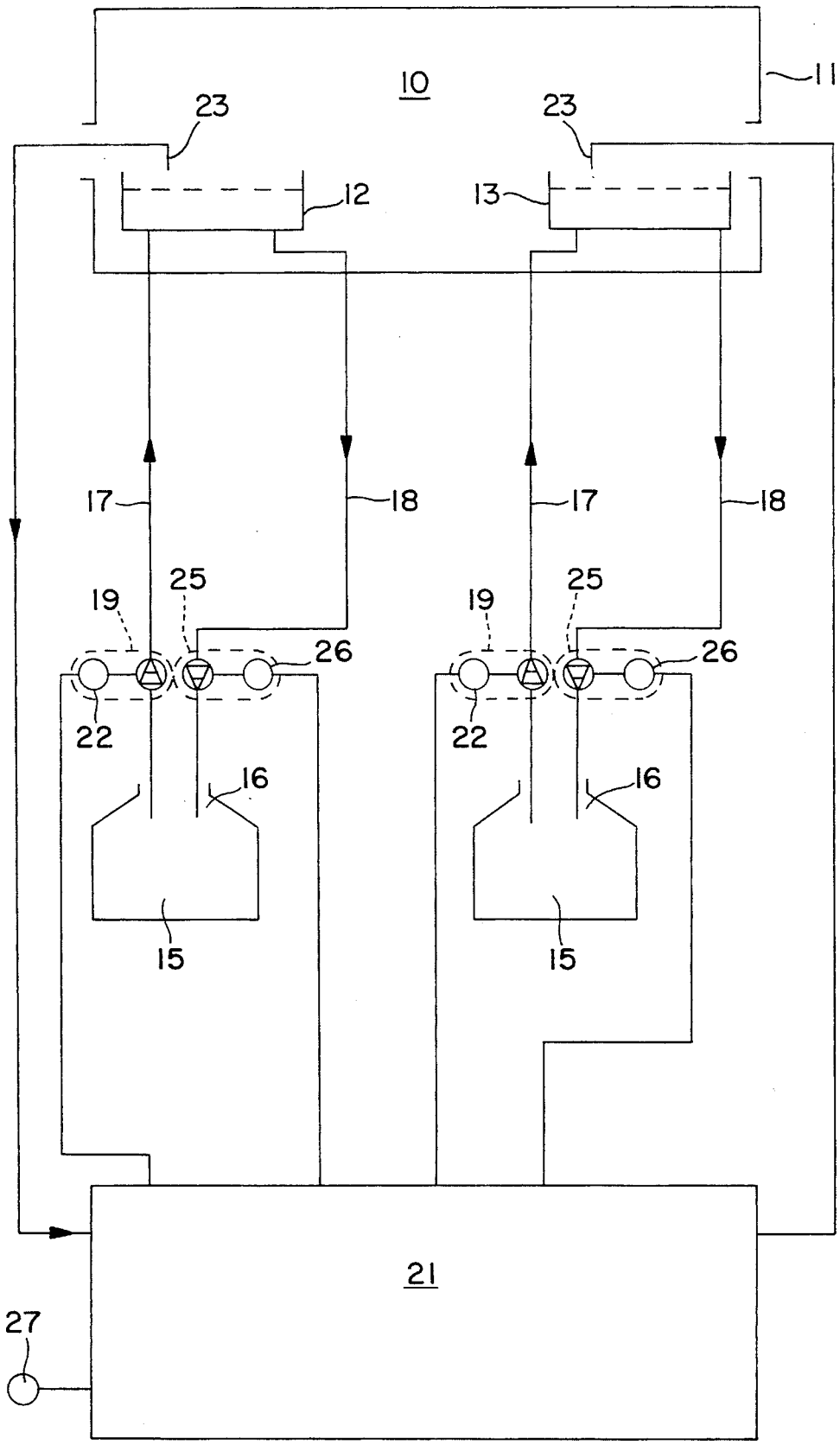
FIG. 1 is a schematic drawing of a photographic processing apparatus according to the invention.

With reference to FIG. 1 of the drawings there is illustrated in schematic form a process apparatus 10 for processing photographic material and in particular for producing off-press colour proofs for accessing the quality of colour separations and colour rendition in printing.

The photographic proof will in the course of its development pass through a liquid developer which develops the silver image, a liquid bleachfixer which removes silver from the proof, a wash to remove non hardened parts and a drier. A proof will have to make four such passes to build up a full colour picture.

The process apparatus 10 has a housing 11 which encloses a development bath 12 and a fixing bath 13. The development bath, in particular, is enclosed as mush as possible to prevent oxidation of the liquid developer in the bath 12.

Essentially the supply and regeneration of process liquid to both baths 12 and 13 is similar.

The process photo-chemical liquids are each supplied in a respective collapsible container 15. Containers known as "cubitainers" which consist of a collapsible plastic cube inside a corrugated board outer support are suitable. The mouth 16 of each container is sealed by a cap 30 (shown in detail in FIGS. 2 and 3) through which a supply conduit 17 and a return conduit 18 pass. The process liquids are delivered to the respective baths 12 or 13 through separate supply conduit 17 by means of a delivery pump 19 located in each supply conduit between the respective bath and container. The delivery pump 19 has a motor 22 connected to a controller 21 which controls the operation of the pump.

A liquid level sensor 23 monitors the presence of liquid in each bath 12 or 13 and is connected to the controller 21 to cause the respective delivery pump 19 to supply the corresponding process liquid to the bath until the liquid level therein has reached a predetermined minimum level. This will automatically compensate for loss of process liquid caused by evaporation and carry over.

A discharge means in the form of an exit pump 25 is located in the return conduit 18 of each respective bath 12,13. Each exit pump 25 is preferably a peristaltic type pump which gives a good shut off when the pump is inoperative. The controller 21 causes each exit pump 25 to operate for a predetermined time period after at predetermined time intervals so that used liquid from each the baths 12, 13 is regularly removed and returned to the respective container 15. This removes process liquid which may degenerate due to both oxidation and use. The time interval between operations of the exit pump, and/or the time period for which the pump is operational may be controlled by a timer control 27. However, said time intervals may also be based on the throughput (i.e. m2) of the processed material.

Figure 2:
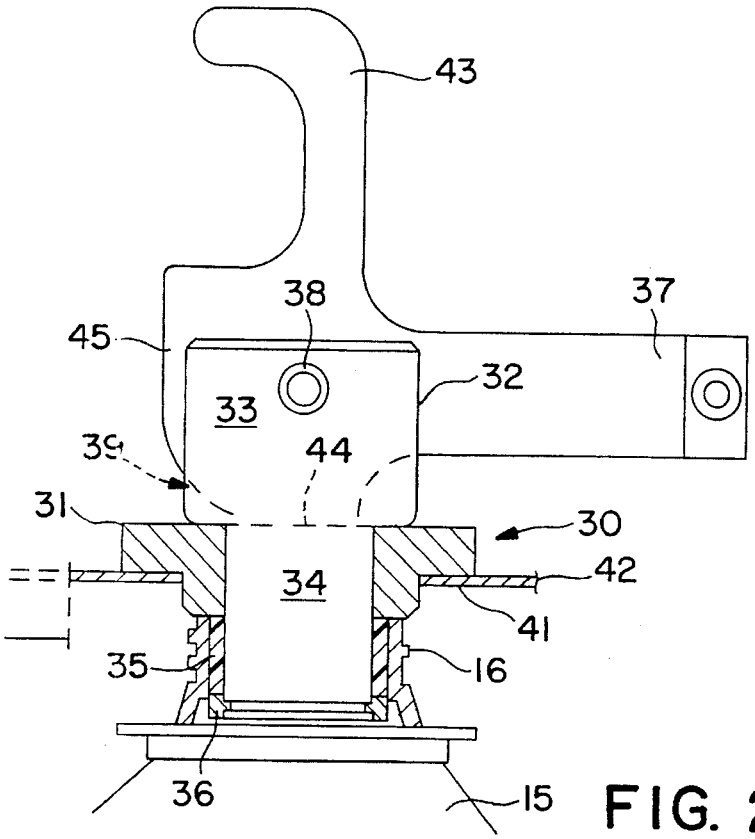
FIG. 2 is a section through a cap according to the invention in the pushed-in condition whilst being disengaged.
Figure 3:
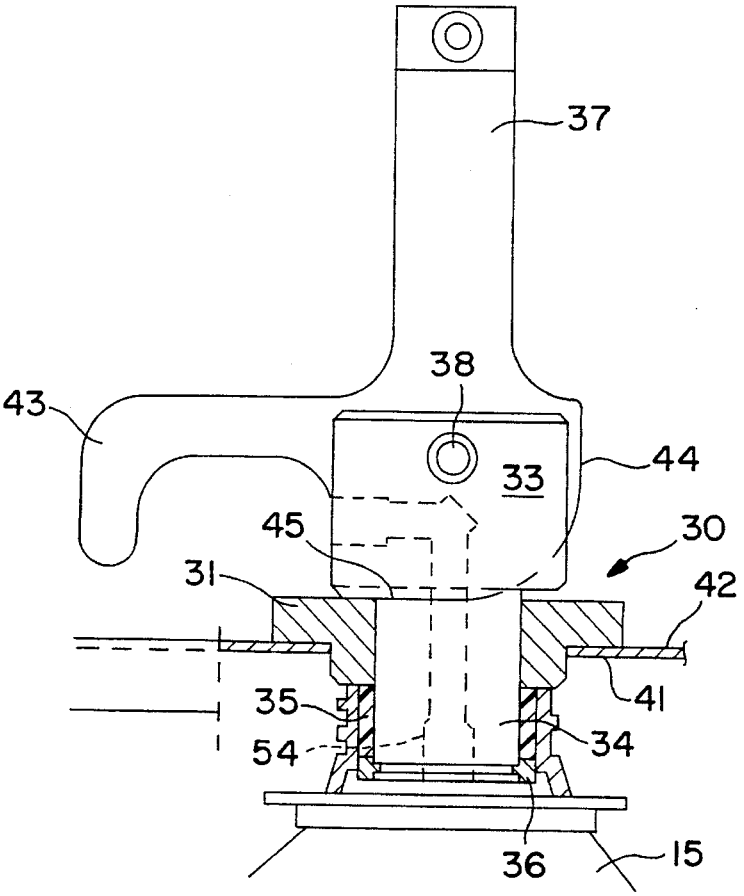
FIG. 3 is similar section to that in FIG. 2 but with the cap in sealed condition.

In order to reduce oxidation of the process liquid in the storage containers 15, especially of the developer, the mouth 16 of the container is hermetically sealed by the cap 30 which is shown in FIGS. 2 and 3.

With reference to FIG. 2 and FIG. 3, each cap 30 comprises an annular cap body 31 which is shown located in an aperture 41 of a support plate 42. A stepped piston 32 has a large diameter head 33 and a smaller diameter stem 34 which extends axially through the centre of the annular body 31 in which it is slidingly supported. An annular elastomeric seal ring 35 is fitted around the portion of the stem 34 extending beyond the cap body 31 and is held in place by a retainer 36 ring fitted to the inner axial end of the stem 34 (that is inner with respect to the container).

A handle 37 is pivoted to the head 33 of the piston by a pin 38; the handle in use has an arcuately curved cam surface portion 39 in contact with the cap body 31 so that as the handle 37 is pivoted about the pin 38 from the horizontal position shown in FIG. 2 to the vertical position shown in FIG. 3 the cam surface 39 acts against the upper end of cap body 31 to relatively displace piston 32 upwardly. The two flat surface portions 44, 45 either side of the cam surface 39 provide a 'lock out' action on the handle 37 in its horizontal and vertical positions respectively.

The distance from the axis of pin 38 to the surface portion 44, which contacts the annular cap body 31 in the "open" condition of the cap, is less than the distance from that axis to the surface 45, which contacts cap body 31 in the "sealed" condition of the cap. Thus, pivotation of handle 37 to shift its contact with cap body 31 from the surface portion 44 to the surface portion 45 displaces piston 32 upwardly relative to the cap body 31, the seal ring 35 is compressed axially between the retainer ring 36 and the inner side side of cap body 31 causing the seal ring to expand radially outwardly.

The handle 37 has an extension 43 thereon which is substantially normal to the handle and which in use can operate a warning device for alerting a user to a state of the cap, e.g. sealed or unsealed.

In use the piston stem 33 of the cap is inserted into the mouth 16 of the container 15 and the handle 37 is pivoted about the pin 38 to cause the seal to expand radially and engage the inner surfaces of the mouth 16 to hermetically seal the cap to the container and retain the cap in position.

The piston 32 has two, liquid passageways 54 (one only shown in FIG. 3) therethrough for the connection of the container 15 to the supply and return conduits 17 and 18.

Figure 4:
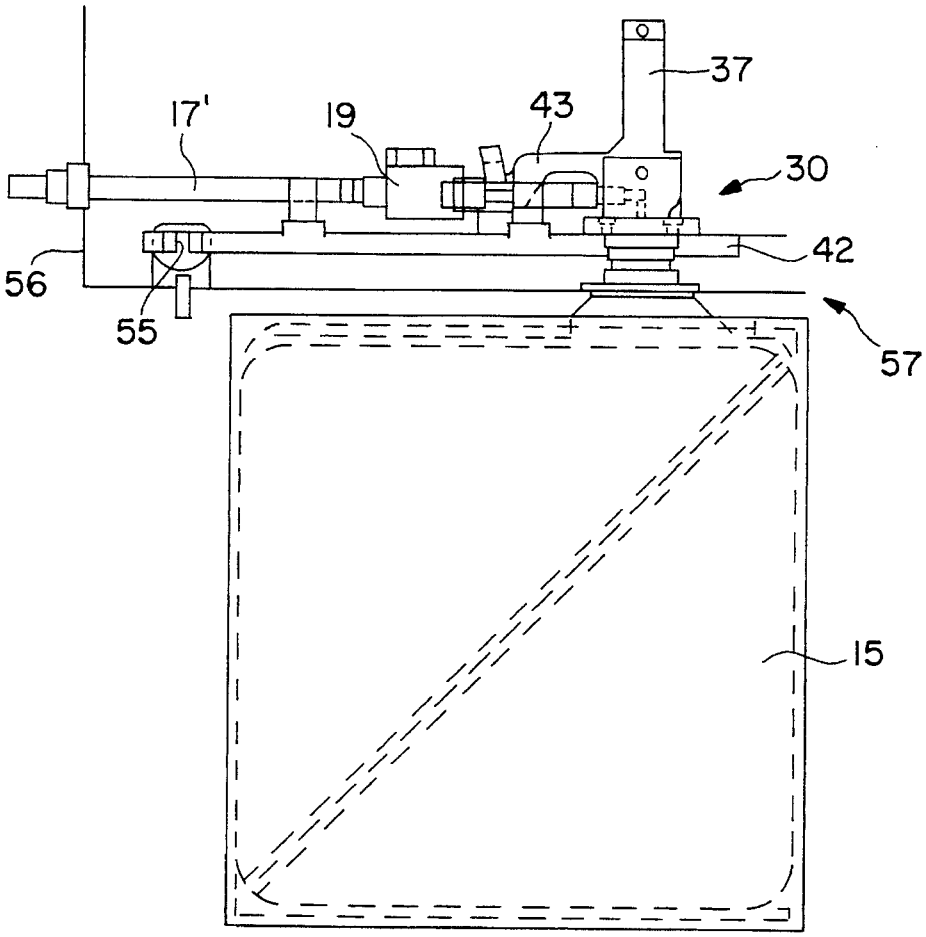
FIG. 4 is a side elevation of an apparatus including a container and cap as shown in FIGS. 2 and 3.
Figure 5:
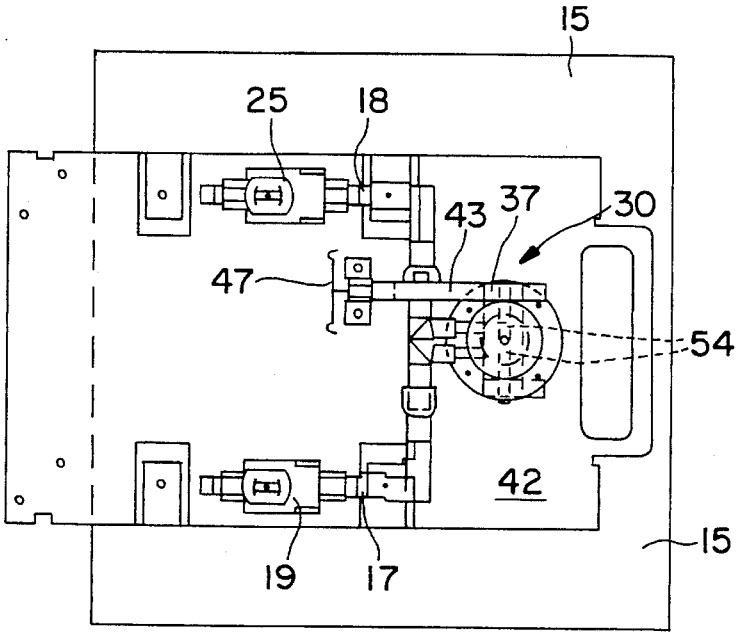
FIG. 5 is a top plan view of the container and cap as shown in FIG. 4, and FIGS. 6A–6D are side elevational views, partially broken away to show cap detail, illustrating shows the stages of installing and connecting a container into an apparatus for processing photographic material.
Figure 6A:
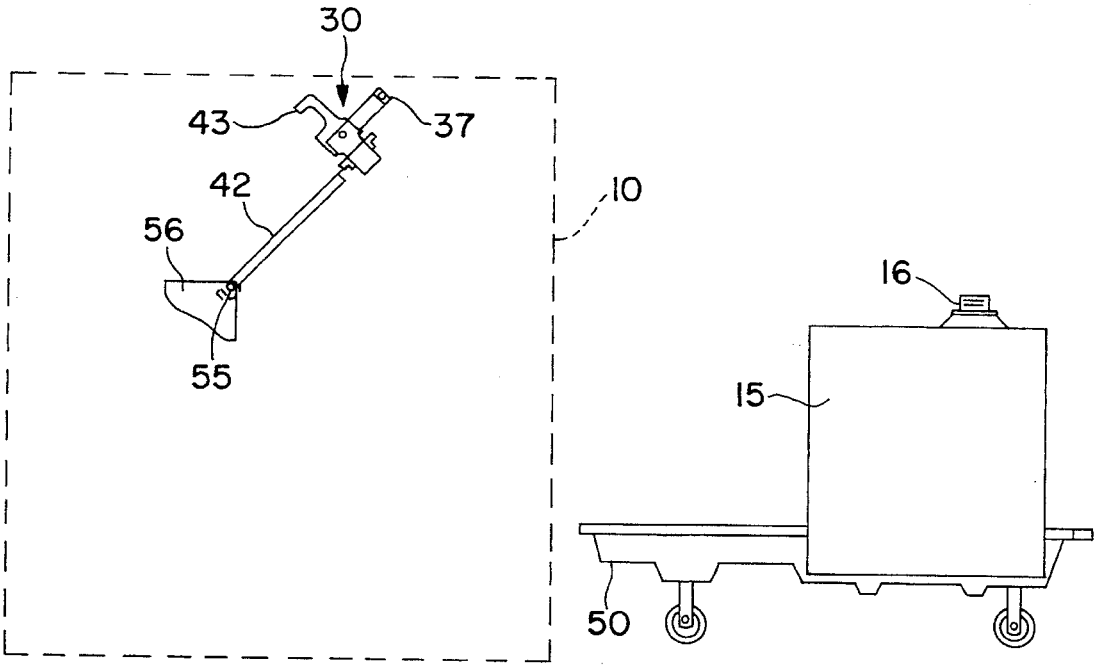
Figure 6B:
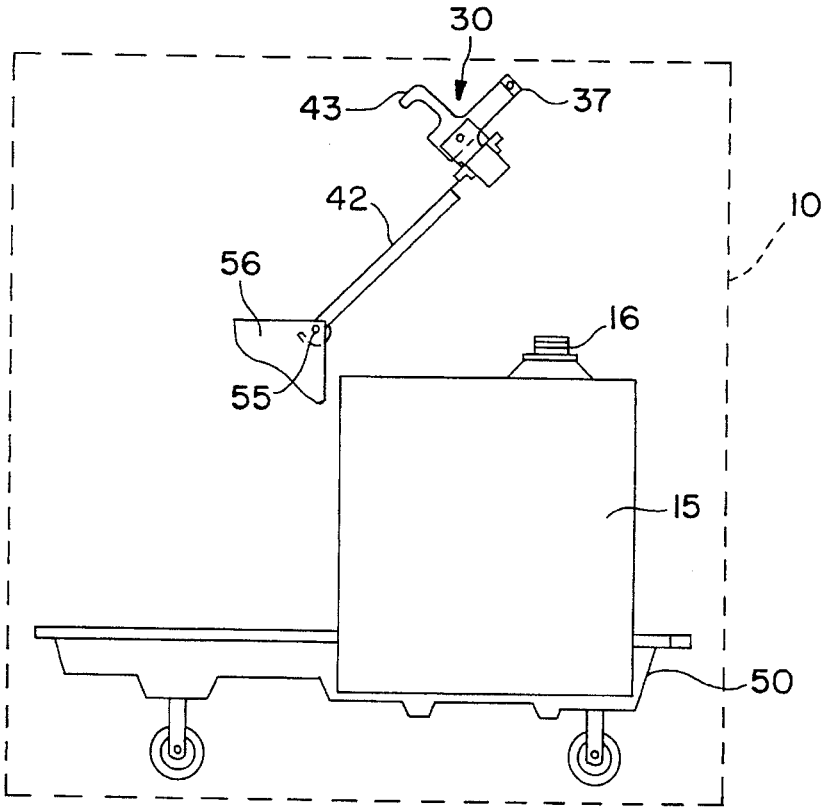
Figure 6C:
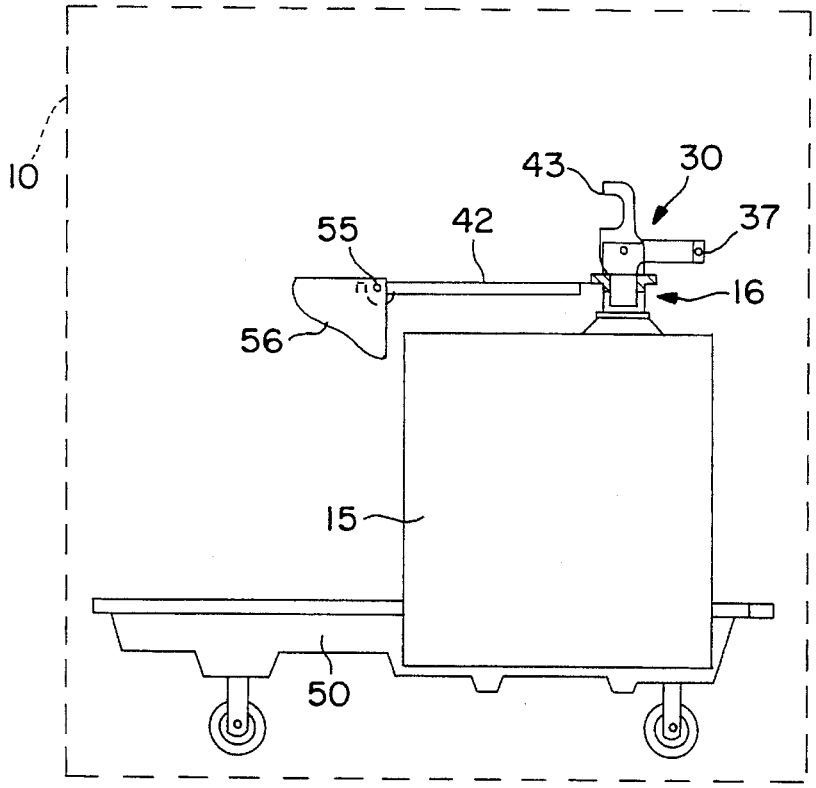
Figure 6D:
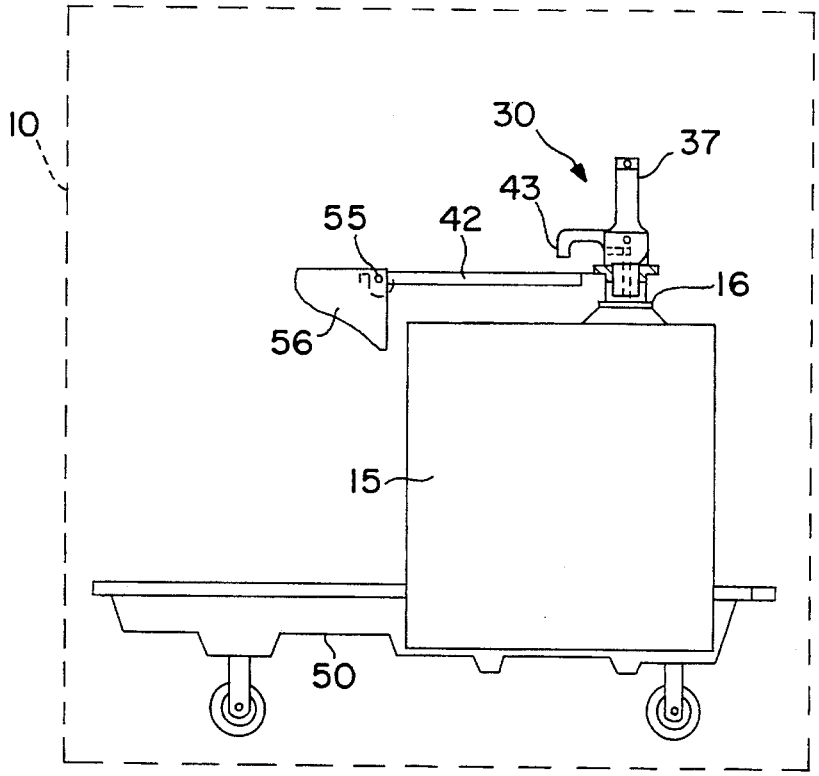

Now with reference to FIGS. 4 and 5 there is shown a cap 30 of the type described with reference to FIGS. 2 and 3, mounted on a support plate 42 which is in turn pivotally connected by a hinge 55 to a frame 56 of the process apparatus 10. The frame 56 may optionally include a fixture plate 57 which fits over the neck of the container 15 to hold the container in position.

Mounted on the support plate 42 are portions of the supply conduit 17 and return conduit 18 which lead to the passageways 54 in the cap.

A switch 47 is also mounted on the support plate 42 and can be activated by the extension 43 of the handle so as to operate a warning device such as a light or buzzer to indicate to the user of the apparatus 10 the condition of the cap 30, i.e. open or sealed.

The delivery pump 19 and return pump 25 may also be mounted on the plate 42 for connection to the respective conduits 17, 18. The pump 19, 25 may be connected to the respective baths 12,13 by flexible conduits 17, 18, allowing for pivoting of the support plate.

All connections may be of the leak proof snap-fit type.

FIGS. *6a–6d* show the steps of locating a fresh container 15 into a process apparatus 10. The plate 42 is in a raised position with handle 37 of the cap 30 in a horizontal condition. The fresh full container 15 is loaded onto a wheeled trolley 50.

The trolley is pushed into the processor 10 and arranged so that its mouth 16 of the container thereon is positioned to receive the cap 30 when the plate 42 is pivoted downwards around the hinge 45.

The plate 42 is then pivoted downwards to insert the cap 30 into the mouth 16 of the container (FIG. *6c*) and is coupled to the container when the handle 37 is pivoted from the vertical to horizontal condition thereby expanding the sealing ring 35 to seal the cap to the container and hold the cap within the mouth 16. To change the container when the process fluid is exhausted, the reverse sequence of events takes place.

We claim:

1. Apparatus for processing photographic material and which comprises at least one process vessel, each such vessel being filled with a processing liquid delivered to the vessel from a storage container, the storage container being connected to the vessel by a push-in/pull-out cap having a radially expandable and contractible resilient seal engageable with the mouth of said container and having a passageway therethrough connected by at least one conduit to the respective process vessel, said cap and each such conduit connected thereto being mounted on a support plate pivoted to a frame of the apparatus so that the cap can be raised and lowered into and out of the mouth of the container.

2. Apparatus according to claim 1, wherein the resilient seal is expanded to engage inner surfaces within the mouth of the container by axial compression of the seal.

3. Apparatus according to claim 2, wherein the cap has a cop body and a seal-actuating means carried by said cap body for limited back-and-forth relative movement, said seal being contacted by said seal-actuating means, whereby relative movement of said seal-actuating means in one direction compresses said seal axially to expand the same against the mouth surfaces and in the opposite direction relaxes the seal to contract the same, and the seal is compressed and relaxed radially through operation of a handle pivotally mounted on the cap for movement between cap-sealed and cap-unsealed positions, said handle having a cam surface thereon operative upon pivotal movement of the handle to move said seal actuating means in said directions, the handle also functioning as a means for lifting the container.

4. Apparatus according to claim 1, which further comprises an electrical switch mounted on the support plate which is operated by a portion of said handle when the handle is in its "cap sealed" position, said switch being adapted to activate an indicating means for indicating the position of said handle.

5. Apparatus according to claim 1, wherein the cap has two fluid passageways therein communicating respectively with a delivery conduit and a return conduit leading to and from the vessel, respectively.

6. Apparatus according to claim 5, which further comprises a delivery pump for delivery of liquid from the container to the process vessel, and a return pump (25) for returning liquid from the vessel to the container mounted on said support plate (42) and connected respectively into said delivery and return conduits.

7. Apparatus according to claim 1, which further comprises a trolley onto which a fresh container of processing liquid can be loaded, said trolley being adapted to be moved from a loading position removed from the apparatus to a position relative to said support plate such that downward pivotal movement of said support plate introduces said cap into the mouth of said fresh container on the troller.

* * * * *